US009574258B2

(12) United States Patent
Inoue et al.

(10) Patent No.: US 9,574,258 B2
(45) **Date of Patent: *Feb. 21, 2017**

(54) ALUMINUM-ALLOY SHEET AND METHOD FOR PRODUCING THE SAME

(75) Inventors: Yuji Inoue, Moka (JP); Yasuhiro Aruga, Kobe (JP); Katsushi Matsumoto, Kobe (JP); Kiyohito Tsuruda, Moka (JP); Kazuharu Masada, Moka (JP)

(73) Assignee: Kobe Steel, Ltd., Kobe-shi (JP)

( * ) Notice: Subject to any disclaimer, the term of this patent is extended or adjusted under 35 U.S.C. 154(b) by 966 days.

This patent is subject to a terminal disclaimer.

(21) Appl. No.: 13/403,389

(22) Filed: Feb. 23, 2012

(65) Prior Publication Data

US 2012/0227871 A1 Sep. 13, 2012

(30) Foreign Application Priority Data

Mar. 10, 2011 (JP) ..... 2011-053573

(51) Int. Cl.

| | |
|---|---|
| ***C22C 21/00*** | (2006.01) |
| ***C22C 21/06*** | (2006.01) |
| ***C22C 21/08*** | (2006.01) |
| ***C22F 1/04*** | (2006.01) |
| ***C22F 1/047*** | (2006.01) |
| ***C22C 1/02*** | (2006.01) |

(52) U.S. Cl.

CPC ..... *C22F 1/047* (2013.01); *C22C 1/026* (2013.01); *C22C 21/06* (2013.01); *C22C 21/08* (2013.01)

(58) Field of Classification Search

CPC . C22F 1/04; C22F 1/047; C22C 21/00; C22C 21/06; C22C 21/08

See application file for complete search history.

(56) References Cited

U.S. PATENT DOCUMENTS

| | | | |
|---|---|---|---|
| 5,681,405 | A | 10/1997 | Newton et al. |
| 5,833,775 | A | 11/1998 | Newton et al. |
| 2002/0043311 | A1 | 4/2002 | Selepack et al. |

(Continued)

FOREIGN PATENT DOCUMENTS

| | | |
|---|---|---|
| CN | 1183813 A | 6/1998 |
| JP | 2000-219929 | 8/2000 |

(Continued)

OTHER PUBLICATIONS

U.S. Appl. No. 13/403,370, filed Feb. 23, 2012, Inoue, et al.

*Primary Examiner* — Jessee Roe
*Assistant Examiner* — Anthony Liang
(74) *Attorney, Agent, or Firm* — Oblon, McClelland, Maier & Neustadt, L.L.P.

(57) ABSTRACT

An aluminum-alloy sheet includes 0.10 to 0.40 mass % of Si, 0.35 to 0.80 mass % of Fe, 0.10 to 0.35 mass % of Cu, 0.20 to 0.80 mass % of Mn, and 1.5 to 2.5 mass % of Mg, the balance being Al and unavoidable impurities, wherein a content ratio (Si/Fe) of the Si to the Fe is 0.75 or less, the area fraction of $Mg_2Si$ intermetallic compound grains having a maximum length of 1 μm or more is 0.10% or more in a region of a section of the aluminum-alloy sheet, the region being a central region in the thickness direction of the aluminum-alloy sheet, and the aluminum-alloy sheet has a proof stress of 225 to 270 $N/mm^2$ after having been baked at 270° C. for 20 seconds.

7 Claims, 4 Drawing Sheets

(56) References Cited

U.S. PATENT DOCUMENTS

| | | | | |
|---|---|---|---|---|
| 2009/0053099 | A1* | 2/2009 | Kajihara et al. | 420/535 |
| 2012/0227870 | A1 | 9/2012 | Inoue et al. | |

FOREIGN PATENT DOCUMENTS

| | | | |
|---|---|---|---|
| JP | 2003-342657 | | 12/2003 |
| JP | 2004-238653 | A | 8/2004 |
| JP | 2004-244701 | | 9/2004 |
| JP | 2004-263253 | A | 9/2004 |
| JP | 2004-339604 | A | 12/2004 |
| JP | 2006-265700 | A | 10/2006 |
| JP | 2007-204793 | | 8/2007 |
| JP | 2010-236075 | A | 10/2010 |
| JP | 2012-188704 | A | 10/2012 |

* cited by examiner

ALUMINUM-ALLOY SHEET AND METHOD FOR PRODUCING THE SAME

BACKGROUND OF THE INVENTION

1. Field of the Invention

The present invention relates to a packaging container used for a beverage or a food, in particular, to an aluminum-alloy sheet that is to be covered by a resin film and then formed into can bodies; and a method for producing the aluminum-alloy sheet.

2. Description of the Related Art

In drawn and ironed (DI) cans and bottle cans (hereafter, DI cans and bottle cans are collectively referred to as aluminum cans), the fabricability, flange formability, and curl formability (formability of opening portions of bottle cans) of the walls can be effectively improved by enhancing ductility of wall portions and neck portions after can forming and heat treatment and by making the Mn content in the aluminum alloy be less than a certain value (to reduce microprecipitates that strongly fix dislocations and inhibit formation of subgrains). On the other hand, Mn is considered as an essential element for achieving high ironing workability and high can strength. Typically, aluminum alloys have a Mn content of 0.5 mass % or more, often 0.8 mass % or more. Accordingly, improvements in the fabricability, flange formability, and curl formability have certain limits, which is a factor that hinders a decrease in the wall thickness and a decrease in the weight of aluminum cans.

Since aluminum-alloy sheets for producing aluminum cans desirably have high formability and a low earing ratio, complete recrystallization textures need to be formed in the stage of hot-rolled sheets. Accordingly, such aluminum-alloy sheets are generally produced in the following manners.

A double soaking in which a slab is subjected to a homogenization heat treatment at a high temperature of about 600° C., then cooled, and heated again is performed so that the solute Mn content of the slab is made less than a certain value and generation of microprecipitates is suppressed (precipitates are grown and made coarse); thus, the production conditions are controlled so that the complete recrystallization texture is obtained at the coiling temperature of the finish hot rolling. Other than the double soaking, there is also two-stage soaking in which a slab is subjected to a homogenization heat treatment at a high temperature of about 600° C., then cooled to about 500° C. at a certain cooling rate, and subsequently hot-rolled.

The techniques of producing aluminum-alloy sheets for aluminum cans from aluminum alloys having the above-described Mn content in the standard manners are disclosed in, for example, Patent Literatures 1 to 4 (Japanese Unexamined Patent Application Publication No. 2000-219929, paragraphs [0018] to [0020]; Japanese Unexamined Patent Application Publication No. 2007-204793, paragraph [0030]; Japanese Unexamined Patent Application Publication No. 2004-244701, paragraphs [0037] to [0038]; and Japanese Unexamined Patent Application Publication No. 2003-342657, paragraphs [0054] to [0062]).

SUMMARY OF THE INVENTION

As described above, to impart high formability to aluminum cans, the Mn content needs to be decreased. In addition, since there is concern about depletion of Mn in the future, aluminum-alloy sheets having a minimum Mn content for aluminum cans need to be developed. In view of the recent trend toward reduction in energy consumption and environmental load, the heat-treatment temperature used when subjecting a slab to a homogenization heat treatment (soaking) is preferably decreased as much as possible; and the establishment of a technique employing soaking at a minimum temperature has been demanded.

However, the techniques disclosed in Patent Literatures 1 to 4 do not meet such demands.

Accordingly, the present invention provides an aluminum-alloy sheet that has high formability and is produced from an aluminum alloy having a minimum Mn content and with lower energy consumption and environmental load than before; and a method for producing the aluminum-alloy sheet.

The inventors of the present invention performed thorough studies and have found the following findings.

In recent years, to reduce the environmental load of can manufacturing processes, a "dry forming technique using a resin-coated aluminum-alloy sheet" by which the aluminum-alloy sheet can be formed without coolants (lubricating and cooling agents) has been widely used. Although this technique was first applied to three-piece bottle cans, it is now about to be applied to two-piece DI cans.

When the "dry forming technique using a resin-coated aluminum-alloy sheet" is performed, since a resin film is present between the ironing die and the aluminum-alloy sheet, the distribution of an Al—Fe—Mn intermetallic compound near the surface of the aluminum-alloy sheet hardly contributes to the ironing workability of the aluminum-alloy sheet. Thus, even when the content of Mn, which is an essential element for forming the Al—Fe—Mn intermetallic compound, is decreased to 0.8 mass % or less, the aluminum-alloy sheet can be continuously ironed.

Such a decrease in the Mn content promotes recrystallization during hot rolling. In addition, by increasing the Mg and Fe contents, the formation of the recrystallization texture is further promoted. The inventors have found that, by appropriately controlling the composition in terms of the elements, even when the heat-treatment temperature for soaking is considerably decreased from that of existing techniques, aluminum-alloy sheets having properties sufficiently suitable as a can body material can be produced.

The increase in the Mg content also contributes to an increase in the strength and hence sufficiently compensates for a decrease in the strength due to the decrease in the Mn content. Thus, aluminum cans having a sufficiently high rigidity can be produced.

A considerable increase in the Mg content leads to an excessive increase in the strength and causes degradation of formability. However, the inventors have found that, by appropriately defining soaking conditions, generation of a $Mg_2Si$ intermetallic compound is promoted to thereby avoid the degradation of formability.

The present invention has been accomplished on the basis of the findings.

An aluminum-alloy sheet according to the present invention includes 0.10 to 0.40 mass % of Si, 0.35 to 0.80 mass % of Fe, 0.10 to 0.35 mass % of Cu, 0.20 to 0.80 mass % of Mn, and 1.5 to 2.5 mass % of Mg, the balance being Al and unavoidable impurities, wherein a content ratio (Si/Fe) of the Si to the Fe is 0.75 or less, an area fraction of $Mg_2Si$ intermetallic compound grains having a maximum length of 1 μm or more is 0.10% or more in a region of a section of the aluminum-alloy sheet, the region being a central region in a thickness direction of the aluminum-alloy sheet, and the aluminum-alloy sheet has a proof stress of 225 to 270 $N/mm^2$ after having been baked at 270° C. for 20 seconds.

Since an aluminum-alloy sheet according to the present invention has a Mn content that is limited to 0.80 mass % or less, recrystallization during hot rolling is promoted. In addition, since the Mg content is made 1.5 mass % or more and the Fe content is made 0.35 mass % or more, the formation of the recrystallization texture is further promoted. Accordingly, even when the heat-treatment temperature for soaking is considerably decreased from that of existing techniques and the number of times the heat treatment is performed is limited to one, an aluminum-alloy sheet having properties (for example, formability and pressure resistance) sufficiently suitable as a can body material can be produced.

Since the area fraction of $Mg_2Si$ intermetallic compound grains is 0.10% or more, degradation of formability due to an excessive increase in the solute Mg content does not occur.

Since the Mn content is limited to 0.80 mass % or less, there may be cases where the Al—Fe—Mn intermetallic compound is not sufficiently formed in the surface of the aluminum-alloy sheet. However, in the ironing of the aluminum-alloy sheet during can manufacturing processes, the aluminum-alloy sheet is covered by a resin that functions as a lubricant and hence problems including seizing can be avoided.

The above-described aluminum-alloy sheet preferably further includes at least one of 0.10 mass % or less of Cr, 0.40 mass % or less of Zn, and 0.10 mass % or less of Ti.

Thus, since an aluminum-alloy sheet according to the present invention may contain certain amounts of Cr and Zn, the proportion of scrap mixed with the aluminum alloy can be increased and, as a result, the material cost of the aluminum-alloy sheet can be decreased. By making the aluminum alloy contain a certain amount of Ti, the size of crystal grains can be reduced without affecting material properties and, as a result, the formability of the aluminum-alloy sheet can be enhanced.

A method for producing an aluminum-alloy sheet for a resin-coated can body according to the present invention includes a casting step of melting an aluminum alloy having the composition of the above-described aluminum-alloy sheet and casting the molten alloy into a slab; a soaking step of homogenizing the slab by a single heat treatment at a maximum temperature of 450° C. to 530° C.; a hot-rolling step of hot rolling the homogenized slab without being cooled, at a finish rolling temperature of 300° C. to 380° C. to form a hot-rolled sheet; and a cold-rolling step of cold rolling the hot-rolled sheet without being annealed, with a total rolling reduction of 80% to 90%.

In this production method, since the maximum temperature of the heat treatment in the soaking step is 450° C. to 530° C., soaking can be performed at a very low temperature, compared with the standard manners (double soaking and two-stage soaking). In addition, unlike the standard manners, the soaking step can be performed by a single heat treatment. Accordingly, use of the production method allows for reduction in energy consumption and environmental load during the production.

In addition, by employing the above-defined soaking conditions, generation of the $Mg_2Si$ intermetallic compound is promoted to thereby avoid the degradation of formability due to an excessive increase in the solute Mg content.

In the above-described production method, the cold rolling of the cold-rolling step is preferably performed with a tandem mill.

The use of a tandem mill increases a rolling reduction in a single rolling operation, compared with the use of a single mill. As a result, the heat value in a single rolling operation becomes stably high and, for example, a saving in the time for coil handling, an increase in the production yield, and a decrease in energy consumption can be achieved. Accordingly, the cold rolling can be efficiently and economically performed and the productivity of the aluminum-alloy sheets is increased.

Advantages

In an aluminum-alloy sheet according to the present invention, even when the Mn content is limited to 0.80 mass % or less, the aluminum-alloy sheet has a specific composition in terms of elements including Mn and, as a result, exhibits properties sufficiently suitable as a can body material. Thus, the Mn content of the aluminum-alloy sheet can be made low.

In an aluminum-alloy sheet according to the present invention, due to the above-described definition of the contents of the elements, the temperature of the heat treatment in the soaking step can be considerably decreased from that of existing techniques, and the number of times the heat treatment is performed in the soaking step can be limited to one. Accordingly, reduction in energy consumption and environmental load can be achieved in the production of the aluminum-alloy sheet. In addition, due to the above-described definition of the contents of the elements, generation of the $Mg_2Si$ intermetallic compound is promoted to thereby enhance the formability of aluminum cans.

In a method for producing an aluminum-alloy sheet for a resin-coated can body according to the present invention, the temperature of the heat treatment in the soaking step is considerably decreased from that of existing techniques, and the number of times the heat treatment is performed in the soaking step is limited to one. Accordingly, use of the production method allows for reduction in energy consumption and environmental load during the production.

According to a method for producing an aluminum-alloy sheet for a resin-coated can body according to the present invention, generation of the $Mg_2Si$ intermetallic compound is promoted to thereby enhance the formability of aluminum cans.

According to an aluminum-alloy sheet and a method for producing the aluminum-alloy sheet according to the present invention, the soaking step can be performed by a single heat treatment and hence the soaking step can be performed in a shorter time and the productivity of the aluminum-alloy sheet can be increased.

DESCRIPTION OF THE PREFERRED EMBODIMENTS

Figure 1:
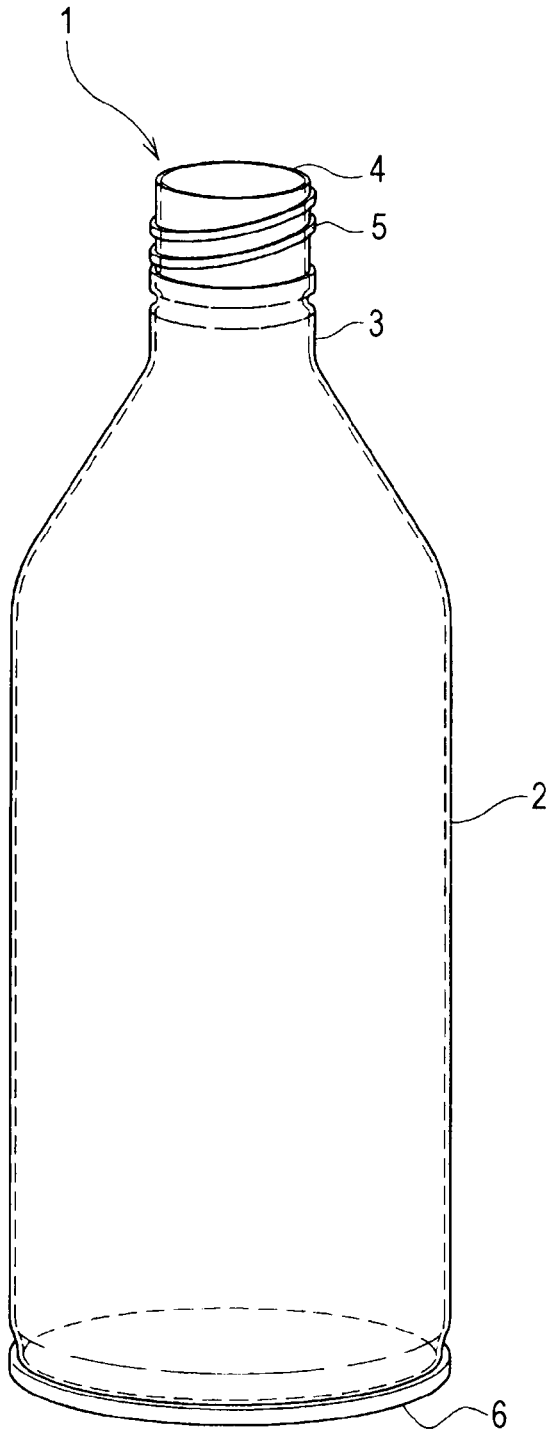
FIG. 1 is a perspective view schematically illustrating an existing bottle can (two-piece bottle can or three-piece bottle can) as an example.

Hereinafter, an aluminum-alloy sheet according to the present invention (hereafter, sometimes referred to as "aluminum-alloy sheet") and a method for producing the aluminum-alloy sheet will be described in detail with reference to the drawings.

The term "aluminum-alloy sheet" denotes an aluminum-alloy sheet that is to be processed into a can body in the following manner: at least one surface of the aluminum-alloy sheet is covered by a protective layer composed of a resin and the resultant sheet is formed into a can body.

Aluminum-alloy Sheet

The aluminum-alloy sheet has a proof stress in the specific range after having been baked. The aluminum-alloy sheet has specific contents of Si, Fe, Cu, Mn, and Mg, the balance being Al and unavoidable impurities. The content ratio of the Si to the Fe (Si/Fe) is the specific value or less. The area fraction of $Mg_2Si$ intermetallic compound grains is defined as the specific value or more.

Hereinafter, reasons for the limitations on the composition of the aluminum-alloy sheet and properties of the aluminum-alloy sheet will be described.

Si: 0.10 to 0.40 Mass %

The Si element influences the recrystallization behavior during hot rolling and the texture. The Si element forms a $Mg_2Si$ intermetallic compound to decrease the strength and hence contributes to formability.

When the Si content is less than 0.10 mass %, the 0°-180° ear height becomes large and hence ear breaking tends to occur during ironing, often resulting in tear off (can-body rupture). In addition, the $Mg_2Si$ intermetallic compound is not sufficiently formed and the strength becomes excessively high and hence flange cracking tends to occur. When the Si content is more than 0.40 mass %, recrystallization is less likely to occur in the hot coil and the worked structure (unrecrystallized region) remains; thus, workability is degraded and tear off tends to occur.

Accordingly, the Si content is defined as 0.10 to 0.40 mass %.

Fe: 0.35 to 0.80 Mass %

The Fe element influences the recrystallization behavior during hot rolling and the texture.

When the Fe content is less than 0.35 mass %, recrystallization is less likely to occur in the hot coil and the worked structure remains; thus, workability is degraded and tear off tends to occur. When the Fe content is more than 0.80 mass %, the Al—Fe—Mn intermetallic compound is excessively generated and cracking (flange cracking) tends to occur during the flange forming of DI cans.

Accordingly, the Fe content is defined as 0.35 to 0.80 mass %.

Cu: 0.10 to 0.35 Mass %

The Cu element contributes to the strength of the aluminum-alloy sheet.

When the Cu content is less than 0.10 mass %, the aluminum-alloy sheet has poor strength and the resultant bottle cans have poor buckling strength in the neck portions and the resultant DI cans have poor pressure strength. When the Cu content is more than 0.35 mass %, recrystallization is less likely to occur in the hot coil and the worked structure remains; thus, workability is degraded and tear off tends to occur. In addition, the strength becomes excessively high and flange cracking tends to occur.

Accordingly, the Cu content is defined as 0.10 to 0.35 mass %.

Mn: 0.20 to 0.80 Mass %

The Mn element contributes to the strength of the aluminum-alloy sheet and also influences the recrystallization behavior during hot rolling and the texture.

When the Mn content is less than 0.20 mass %, the aluminum-alloy sheet has poor strength and the resultant bottle cans have poor buckling strength in the neck portions and the resultant DI cans have poor pressure strength. When the Mn content is more than 0.80 mass %, recrystallization is less likely to occur in the hot coil and the worked structure remains; thus, workability is degraded and tear off tends to occur. In addition, the Al—Fe—Mn intermetallic compound is excessively formed and cracking tends to occur during the flange forming of DI cans.

Accordingly, the Mn content is defined as 0.20 to 0.80 mass %.

Mg: 1.5 to 2.5 Mass %

The Mg element contributes to the strength of the aluminum-alloy sheet.

When the Mg content is less than 1.5 mass %, the aluminum-alloy sheet has poor strength and the resultant bottle cans have poor buckling strength in the neck portions and the resultant DI cans have poor pressure strength. When the Mg content is more than 2.5 mass %, seizing tends to occur in the surfaces of the aluminum-alloy sheet during hot rolling and the resultant cans tend to have deteriorated appearances due to flow marks in can wall portions. In addition, the strength becomes excessively high and tear off and flange cracking tend to occur.

Accordingly, the Mg content is defined as 1.5 to 2.5 mass %.

Balance: Al and Unavoidable Impurities

The balance of the composition of the aluminum-alloy sheet includes Al and unavoidable impurities. For example, the aluminum-alloy sheet may contain, as the unavoidable impurities, 0.10 mass % or less of Zr and 0.05 mass % or less of B because advantages provided by the present invention are not degraded.

As described above, the Si and Fe contents of the aluminum-alloy sheet are defined. In addition, the content ratio of the Si to the Fe (Si/Fe) is further defined as the specific value or less.

Si/Fe: 0.75 or Less

When the content ratio of Si to Fe (Si/Fe) is more than 0.75, recrystallization is less likely to occur in the hot coil and the worked structure remains; thus, workability is degraded and tear off tends to occur. Accordingly, the content ratio of Si to Fe (Si/Fe) is defined as 0.75 or less.

Area Fraction of $Mg_2Si$ Intermetallic Compound Grains: 0.10% or More

In a central region (in the sheet-thickness direction) of a section of the aluminum-alloy sheet, the area fraction of $Mg_2Si$ intermetallic compound grains having a maximum length of 1 μm or more is 0.10% or more. Specifically, the central region (in the sheet-thickness direction) of the section denotes a region ranging from a height of 0.3×t (t: sheet thickness) to a height of 0.7×t in the sheet-thickness direction.

When the area fraction is less than 0.10%, the aluminum-alloy sheet has an excessively high strength and, as a result, tear off tends to be caused during ironing and cracking tends to be caused during flange forming.

Accordingly, the area fraction of $Mg_2Si$ intermetallic compound grains is 0.10% or more.

The area fraction of $Mg_2Si$ intermetallic compound grains can be controlled by adjusting the contents of Mg and Si. The area fraction can also be controlled by performing a soaking step described below under appropriate conditions (temperature range and the number of times a heat treatment is performed).

The $Mg_2Si$ intermetallic compound grains can be identified with, for example, a scanning electron microscope (SEM). In a composition (COMPO) image obtained with a SEM, the $Mg_2Si$ intermetallic compound grains can be identified using the difference in contrast from the matrix. The Al—Fe—Mn and Al—Fe—Mn—Si intermetallic compound grains look lighter than the Al matrix. The $Mg_2Si$ intermetallic compound grains look darker than the Al matrix. The $Mg_2Si$ intermetallic compound grains in a central region (in the sheet-thickness direction) of a section of the aluminum-alloy sheet are observed in the following manner. The aluminum-alloy sheet is cut and the resultant section extending in the rolling direction and the sheet-thickness direction is polished so as to have a mirror surface. In this mirror surface, a region ranging from a height of 0.3×t (t: sheet thickness) to a height of 0.7×t in the sheet-thickness direction is observed. In this region, a plurality of fields of view (in total: 1 $mm^2$ or more) are preferably observed and photographed. The micrographs are processed with, for example, an image processing device to determine the area fraction of $Mg_2Si$ intermetallic compound grains.

Proof Stress After Baking: 225 to 270 $N/mm^2$

An important property of an aluminum-alloy sheet for a resin-coated can body is a proof stress (0.2% proof stress) of the sheet after the sheet is heat-treated at 270° C. for 20 seconds. These conditions simulate baking performed after printing or painting.

The proof stress of the aluminum-alloy sheet can be controlled by adjusting the contents of Cu, Mn, and Mg, by performing the soaking step described below under appropriate conditions (temperature range and the number of times a heat treatment is performed), and by adjusting the rolling reduction of cold rolling described below.

When an aluminum-alloy sheet has a proof stress of 225 $N/mm^2$ or more after having been heat-treated at 270° C. for 20 seconds, the sheet satisfies can properties such as can strength that are required as a resin-coated can body. When the proof stress is more than 270 $N/mm^2$, a high working force is required in forming and hence formability is degraded.

Accordingly, the aluminum-alloy sheet is defined to have a proof stress of 225 to 270 $N/mm^2$ after having been baked at 270° C. for 20 seconds.

The aluminum-alloy sheet may further contain, as an optional component, at least one of Cr, Ti, and Zn in specific amounts.

Cr: 0.10 Mass % or Less

In an aluminum-alloy sheet that is to be coated with a resin and then formed into a can, prior to the coating with the resin, the sheet is subjected to a chromate-phosphate process for enhancing the adhesion between the sheet and the resin. As a result, the sheet naturally has a higher Cr content than sheets that are not coated with resins. When the aluminum-alloy sheets to be coated with a resin may contain Cr, the scrap generated during manufacturing of cans from the aluminum-alloy sheets can be used in larger amounts as a raw material. When the Cr content is 0.10 mass % or less, recrystallization sufficiently occurs in the hot coil and the worked structure is less likely to remain; thus, workability is less likely to be degraded and tear off is less likely to occur.

Accordingly, the Cr content is preferably 0.10 mass % or less.

Ti: 0.10 Mass % or Less

The Ti element contributes to the refinement of a slab texture. When Ti is added to refine a slab texture during casting, castability is enhanced and high-speed casting can be performed. This advantage is provided when 0.01 mass % or more of Ti is added. When 0.10 mass % or less of Ti is added, clogging of the filter is less likely to be caused and the molten metal is smoothly passed through the filter during casting. Thus, the casting can be appropriately performed.

Accordingly, the Ti content is preferably 0.10 mass % or less.

When Ti is added, a slab refiner (Al—Ti—B) having a content ratio of Ti:B=5:1 is added in the shape of a waffle or a rod to molten metal to be cast. Accordingly, B is also added in an amount according to the content ratio.

Zn: 0.40 Mass % or Less

The Zn element is considered as an impurity. The Zn content of 0.40 mass % or less does not affect material properties or can properties. Intentional addition of Zn is advantageous for increasing the proportion of scrap mixed with a raw material (for example, increasing the amount of a scrap used, the scrap being derived from cladding members for heat exchangers) and eventually decreasing the raw-material cost.

Accordingly, the Zn content is preferably 0.40 mass % or less.

Hereinafter, a method for producing an aluminum-alloy sheet for a packaging container according to the present invention will be described.

Method for Producing Aluminum-alloy Sheet for Resin-coated Can Body

A method for producing an aluminum-alloy sheet for a resin-coated can body includes a casting step, a soaking step, a hot-rolling step, and a cold-rolling step.

These steps are described below.

Casting Step

In the casting step, an aluminum alloy having the above-described composition is melted and the molten alloy is cast into a slab.

The processes of melting the aluminum alloy and casting the molten alloy are not particularly limited and may be existing processes. For example, the aluminum alloy is melted with a vacuum induction furnace and the molten alloy is cast by continuous casting or semicontinuous casting.

Soaking Step

In the soaking step, the slab having been prepared in the casting step is subjected to a homogenization heat treatment.

In the soaking step, a single heat treatment is performed at a maximum temperature of 450° C. to 530° C. When the maximum temperature is less than 450° C., the coiling temperature in the finish hot rolling does not become sufficiently high for recrystallization and hence recrystallization does not occur in the hot coil. In addition, it becomes difficult to perform rolling itself. When the maximum temperature is more than 530° C., the amount of the $Mg_2Si$ intermetallic compound generated becomes small and hence the strength of the material becomes high and the formability is degraded.

By using an aluminum alloy having the above-described composition, even when the single heat treatment at the low temperature is performed as the soaking step, an aluminum-alloy sheet having properties sufficiently suitable as a can body material can be produced.

The holding time (time over which the temperature of 450° C. or more is held) in the soaking step is preferably 2 or more hours.

When the holding time is 2 or more hours, homogenization of the slab is reliably achieved.

Hot-rolling Step

In the hot-rolling step, the slab having been subjected to the homogenization heat treatment in the soaking step is hot-rolled without being cooled, to form a rolled sheet.

This hot rolling is performed at a finish rolling temperature of 300° C. to 380° C. When the finish rolling temperature is less than 300° C., recrystallization does not occur in the hot coil and the worked structure remains; thus, the 45° ear height becomes large in the cold-rolled sheet (product sheet) and tear off tends to occur during ironing. When the finish rolling temperature is more than 380° C., an oxide film is excessively generated and seizing is caused in the surfaces of the sheet. Thus, the resultant cans have poor surface quality and hence have no commercial value.

The process for performing the hot rolling is not particularly limited and may be an existing process.

Cold-rolling Step

In the cold-rolling step, the rolled sheet having been formed in the hot-rolling step is cold-rolled to produce an aluminum-alloy sheet.

This cold rolling is performed with a total rolling reduction of 80% to 90%. When the total rolling reduction is less than 80%, the resultant sheet has poor strength. When the total rolling reduction is more than 90%, the strength becomes excessively high and the 45° ear height becomes large. This increase in the 45° ear height leads to frequent occurrence of tear off during ironing.

In the cold-rolling step, annealing (process annealing) is not performed between cold-rolling processes. Annealing causes serious work hardening during forming and, for example, wrinkling is caused during necking and hence the neck formability is degraded. Annealing also requires an extra step, which increases the production cost.

The cold rolling of the cold-rolling step is preferably performed with a tandem mill. The use of a tandem mill increases a rolling reduction in a single rolling operation, compared with the use of a single mill. As a result, the heat value in a single rolling operation becomes stably high and, for example, a saving in the time for coil handling, an increase in the production yield, and a decrease in energy consumption can be achieved. Accordingly, the cold rolling can be efficiently and economically performed and the productivity of the aluminum-alloy sheets is increased.

Figure 2:
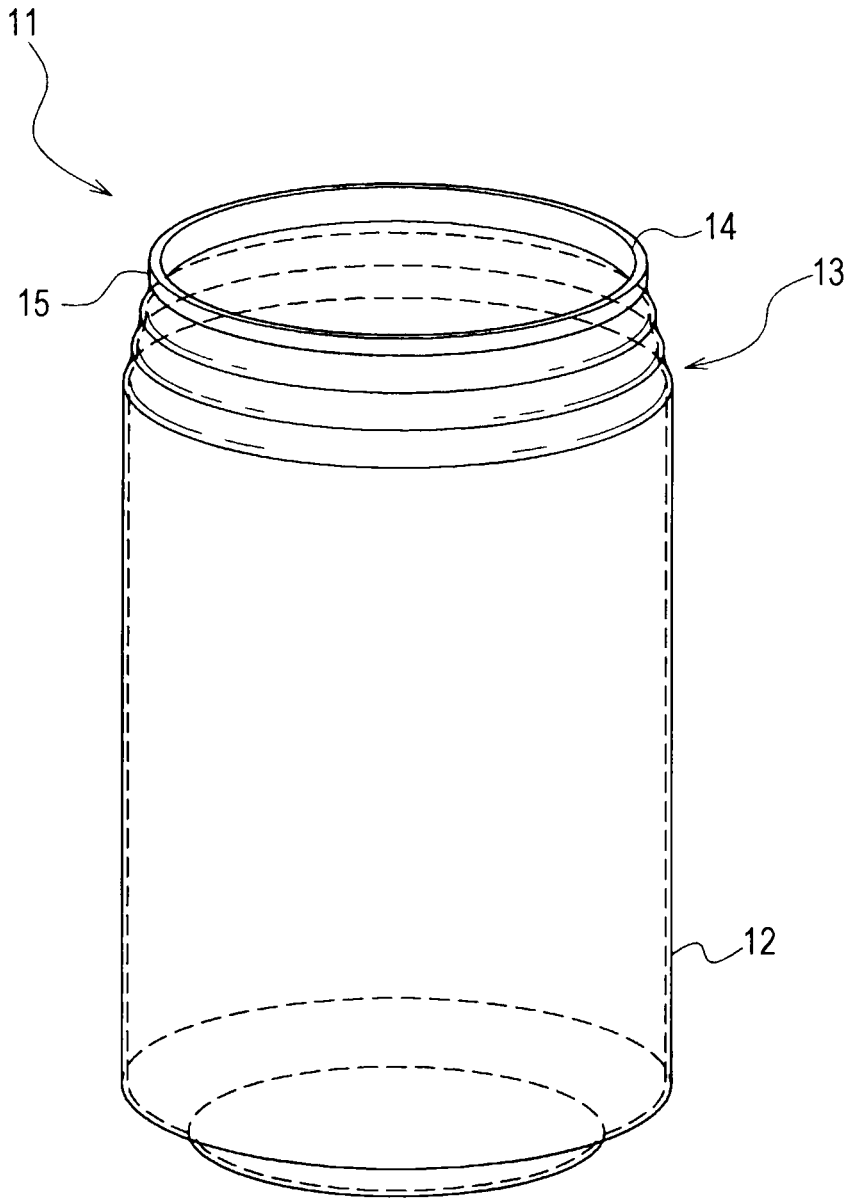
FIG. 2 is a perspective view schematically illustrating an existing DI can as an example.

An aluminum-alloy sheet for a resin-coated can body according to the present invention described above is suitably applicable to, for example, a bottle can 1 (two-piece bottle can or three-piece bottle can) illustrated in FIG. 1 as an example of existing cans and a DI can 11 illustrated in FIG. 2 as an example of existing cans.

An aluminum-alloy sheet for a resin-coated can body according to the present invention is processed into a laminate member (resin-coated aluminum-alloy sheet) by, for example, affixing resin films selected from various resin films used for existing laminate members to the surfaces of the aluminum-alloy sheet with, for example, an adhesive and then by heating the affixed resin films at a temperature equal to or more than the melting point of the films.

Figure 3A:
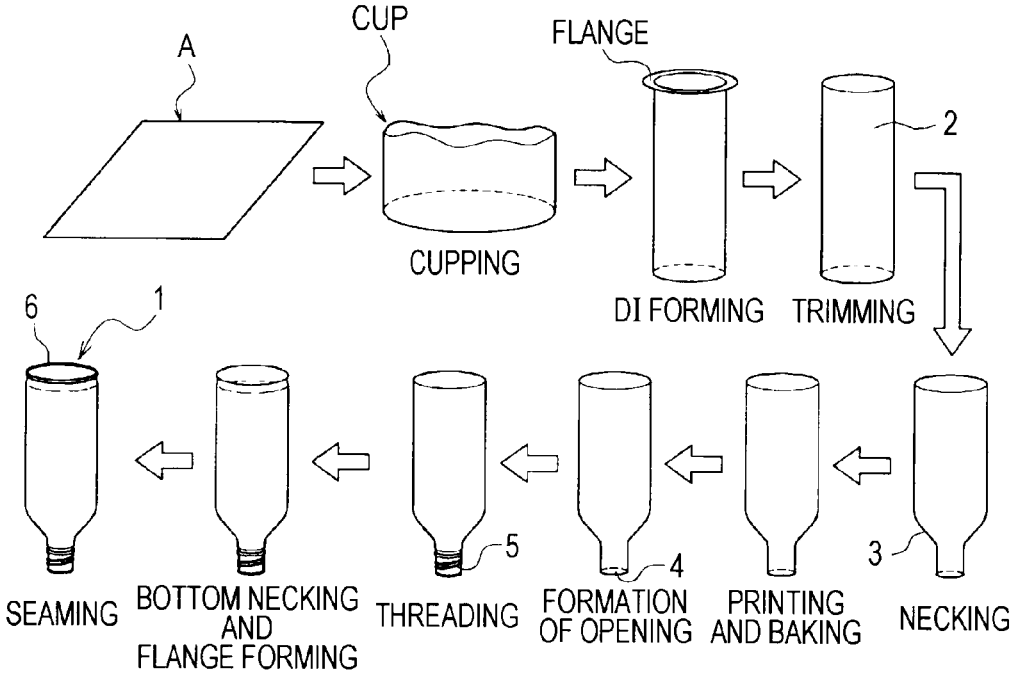
FIG. 3A is a schematic view illustrating a method for producing a bottle can (three-piece bottle can)

A laminate member A prepared from an aluminum-alloy sheet for a resin-coated can body according to the present invention may be applied to the bottle can 1 in FIG. 1, which is a typical bottle can, in the following manner (the case of a three-piece bottle can will be described as an example). Referring to FIG. 3A, the laminate member A is subjected to can-body forming including cupping and DI forming to form a closed-bottomed cylindrical can (body 2). The bottom portion of the closed-bottomed cylindrical can (body 2) is then necked to form a neck 3. The body 2 is subsequently subjected to printing and baking. An opening 4 is formed in the neck 3. The neck 3 is then threaded to form a thread 5 for engagement with a cap. Another open-end portion of the body 2 is subjected to necking (bottom necking) and flange forming. A bottom cover that is separately formed is then seamed to the end of the body 2 with a seamer to thereby form a bottom 6. Thus, the three-piece bottle can 1 has been manufactured.

Figure 3B:
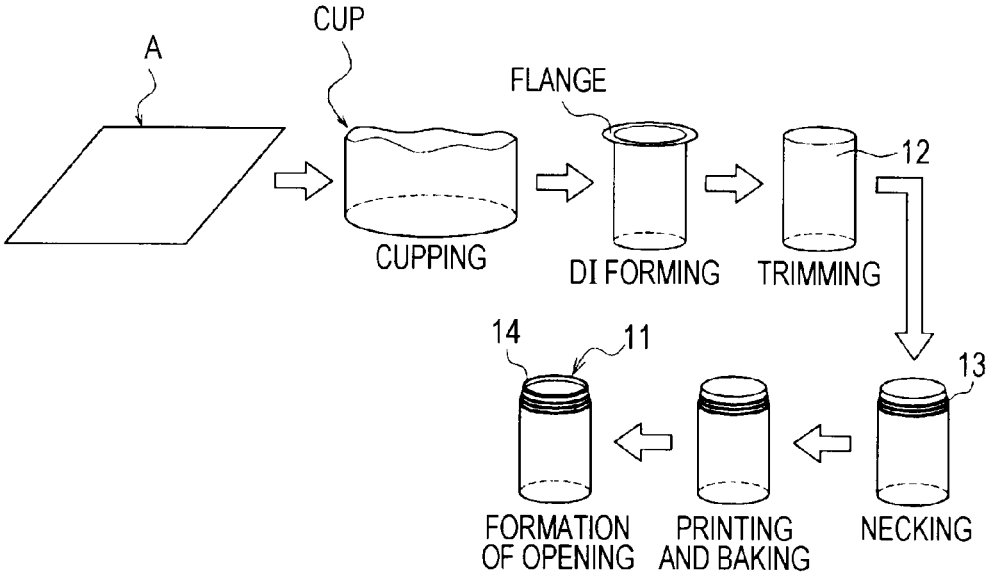
FIG. 3B is a schematic view illustrating a method for producing a DI can.

A laminate member A prepared from an aluminum-alloy sheet for a resin-coated can body according to the present invention may be applied to the DI can 11 in FIG. 2, which is a typical DI can, in the following manner. Referring to FIG. 3B, the laminate member A is subjected to can-body forming including cupping and DI forming to form a closed-bottomed cylindrical can (body 12). The closed-bottomed cylindrical can (body 12) is then necked to form a neck 13. The body 12 is subsequently subjected to printing and baking. An opening 14 is formed at the end of the neck 13 such that the diameter of the opening 14 is less than that of the body 12. Thus, the DI can 11 has been manufactured.

EXAMPLES

Hereinafter, an aluminum-alloy sheet for a packaging container according to the present invention will be specifically described with comparison between Examples that satisfy the requirements of the present invention and Comparative examples that do not satisfy the requirements of the present invention.

Production of Aluminum-alloy Sheets

Aluminum alloys having compositions described in Examples to 12 and Comparative examples 1 to 20 in Table 1 were melted and the molten alloys were cast into slabs having a thickness of 600 mm by semicontinuous casting.

Each slab was then subjected to scalping, soaking, rough hot rolling, and finish hot rolling in this order to form a hot coil (hot-rolled sheet). The hot coil was cold-rolled to produce an aluminum-alloy sheet (thickness: 0.300 mm) for aluminum cans.

The conditions of the soaking, hot rolling (rough hot rolling and finish hot rolling), and cold rolling are summarized in Table 1.

Property of Aluminum-alloy Sheets

A property of the thus-produced aluminum-alloy sheet, that is, the 0.2% proof stress of the aluminum-alloy sheet after the produced sheet (cold-rolled sheet) was baked (heat-treated) at 270° C. for 20 seconds was measured in the following manner.

A JIS No. 5 specimen was sampled from the aluminum-alloy sheet having been baked at 270° C. for 20 seconds. The specimen was subjected to a tensile test in accordance with JIS Z2241 to thereby measure the 0.2% proof stress of the baked aluminum-alloy sheet.

Area Fraction of $Mg_2Si$ Intermetallic Compound Grains

The area fraction of $Mg_2Si$ intermetallic compound grains was measured in the following manner.

A section was sampled from the aluminum-alloy sheet and embedded in a resin. The section was polished so as to have an observation surface (mirror surface) extending in the rolling direction and the sheet-thickness direction. The mirror surface was observed through composition (COMPO) images (20 fields of view) obtained therefrom with a scanning electron microscope (SEM) at an acceleration voltage of 15 kV and at a magnification of 500 times.

The observed region was in the range from a height of 0.3×t (t: sheet thickness) to a height of 0.7×t in the sheet-thickness direction. Portions looked lighter than the matrix were identified as grains of the Al—Fe—Mn—Si intermetallic compound and the Al—Fe—Mn intermetallic compound. Portions looked darker than the matrix were identified as $Mg_2Si$ intermetallic compound grains. The images were subjected to image processing to thereby determine the total area of $Mg_2Si$ intermetallic compound grains having a maximum length of 1 μm or more and calculate the area fraction of the $Mg_2Si$ intermetallic compound grains.

Formation of Can Bodies of DI Cans

The aluminum-alloy sheet was subjected to a chromate-phosphate process. Each surface of the aluminum-alloy sheet was laminated with a polyethylene terephthalate resin film having a thickness of 16 μm. The resultant sheet was subjected to drawing (cupping) and then DI forming (ironing). The open-end portion was trimmed. Thus, a closed-bottomed cylindrical can body that had an outer diameter of 66 mm, a height of 124 mm, and a wall thickness of 0.1 mm (excluding the films) was formed. The can body was heat-treated at 270° C. for 20 seconds, which simulated baking performed after printing or painting. Thus, a specimen was prepared.

Evaluations of DI-Can Forming

Ironing Workability

Each aluminum-alloy sheet was processed to manufacture 10000 can bodies. Specifically, the aluminum-alloy sheet was blanked out to provide blanks having a diameter of 140 mm and the blanks were subjected to cupping to provide cups having a diameter of 90 mm. The cups were then subjected to DI forming such that the third ironing was performed with an ironing ratio of 40%. In the DI forming, a case where four or less can bodies underwent tear off (can-body rupture) was evaluated as "Good"; and a case where five or more can bodies underwent tear off was evaluated as "Poor".

Evaluation of Flange Formability

Figure 4A:
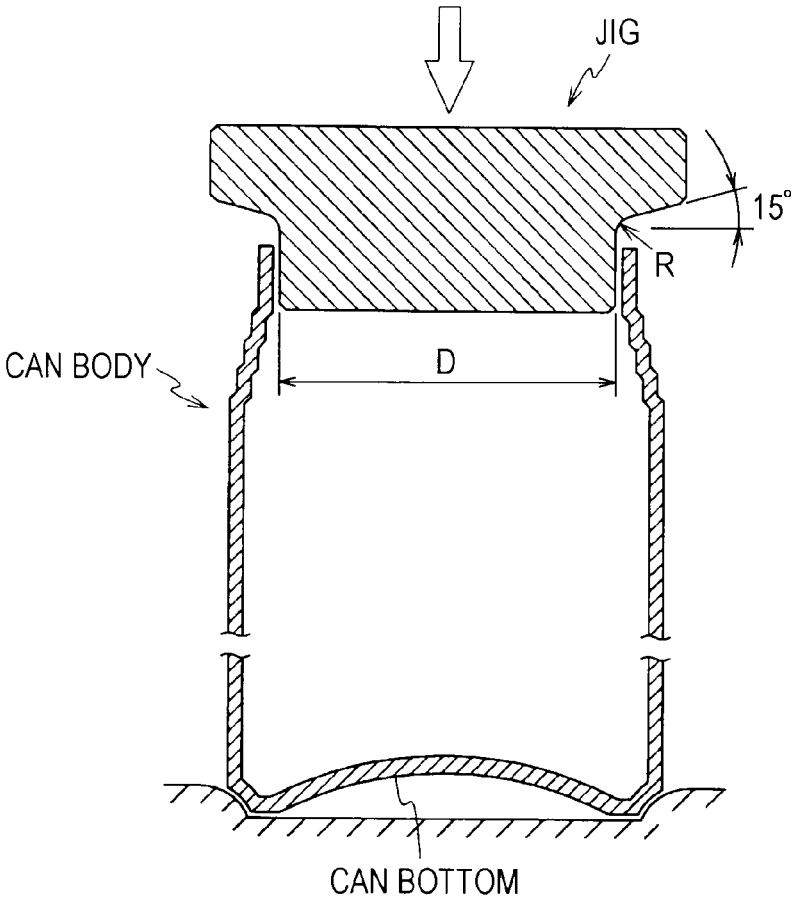
FIGS. 4A and 4B are sectional views schematically illustrating a method for evaluating the flange formability of a can body.
Figure 4B:
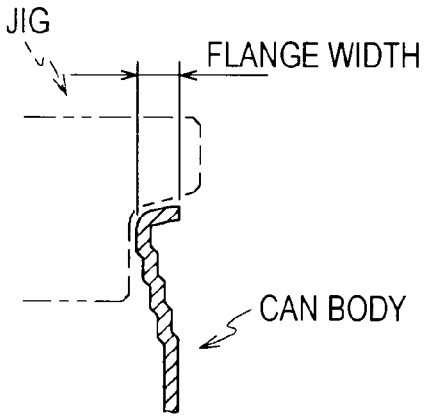

Of the can bodies, 20 can bodies were necked such that each open-end portion had a four-step structure and the open-end portion had an inner diameter of 57.3 mm. Referring to FIGS. 4A and 4B, each of the resultant can bodies was processed in the following manner. While the can bottom was fixed, a can expanding jig was inserted from the open-end portion and pushed toward the can bottom to thereby diametrically expand the open-end portion. The diameter (D in FIG. 4A) of the insertion portion of the jig was 57.3 mm. The radius (R in FIG. 4A) of curvature of the diameter-increasing portion of the jig was 3.0 mm. The area of the jig in contact with the can body was coated with a lubricant (water-soluble plastic-working oil No. 700, manufactured by Castrol Industrial). The jig was pushed into the can body until the can body was ruptured at the rim of the open-end portion. A can-expanding ratio ({(diameter of expanded open-end portion/diameter of open-end portion to be expanded)−1}×100%) was calculated.

A case where the average can-expanding ratio was 12% or more was evaluated as "Good"; and a case where the average can-expanding ratio was less than 12% was evaluated as "Poor".

Evaluation of Pressure Strength

Of the above-described can bodies, 20 can bodies were subjected to increasing internal pressure with a hydrostatic pressure strength tester and the maximum internal pressure at which buckling occurred was defined as the pressure strength. A case where the average pressure strength was 647 kPa or more (6.6 kg/cm$^2$ or more) was evaluated as "Good"; and a case where the average pressure strength was less than 647 kPa (less than 6.6 kg/cm$^2$) was evaluated as "Poor".

Evaluation of Flow Marks

Of the above-described can bodies, the walls of 20 can bodies were visually inspected. A case where each of the 20 can bodies had one or less black loop line (flow mark) was evaluated as "Good"; and a case where at least one can body had two or more flow marks was evaluated as "Poor".

The compositions, production conditions, and test results of the aluminum-alloy sheets are summarized in Table 1. In Table 1, values that did not satisfy the requirements of the present invention and pressure strengths that were evaluated as "Poor" are underlined.

TABLE 1

| Specimen | | Composition of aluminum alloys [mass %] | | | | | | | | Si/Fe | Soaking temperature | Finish hot-rolling temperature | Cold-rolling reduction |
|---|---|---|---|---|---|---|---|---|---|---|---|---|---|
| Category | No. | Si | Fe | Cu | Mn | Mg | Cr | Zn | Ti | ratio | [° C.] | [° C.] | [%] |
| Example | 1 | 0.12 | 0.37 | 0.33 | 0.36 | 1.77 | — | — | — | 0.324 | 530 | 338 | 86 |
| | 2 | 0.18 | 0.68 | 0.13 | 0.76 | 2.20 | — | — | — | 0.265 | 470 | 324 | 87 |
| | 3 | 0.28 | 0.57 | 0.21 | 0.64 | 1.93 | — | — | — | 0.491 | 510 | 355 | 87 |
| | 4 | 0.37 | 0.77 | 0.22 | 0.23 | 2.42 | — | — | — | 0.481 | 510 | 330 | 85 |
| | 5 | 0.29 | 0.40 | 0.17 | 0.46 | 2.33 | — | — | — | 0.725 | 490 | 361 | 88 |
| | 6 | 0.27 | 0.54 | 0.22 | 0.67 | 1.95 | 0.05 | — | — | 0.500 | 510 | 370 | 84 |
| | 7 | 0.26 | 0.53 | 0.18 | 0.69 | 2.02 | — | 0.30 | — | 0.491 | 510 | 366 | 86 |
| | 8 | 0.27 | 0.58 | 0.24 | 0.64 | 1.59 | — | — | 0.04 | 0.466 | 510 | 376 | 85 |
| | 9 | 0.28 | 0.55 | 0.23 | 0.61 | 1.94 | 0.05 | 0.30 | — | 0.509 | 510 | 369 | 88 |
| | 10 | 0.27 | 0.52 | 0.20 | 0.65 | 2.03 | 0.05 | — | 0.04 | 0.519 | 510 | 360 | 85 |
| | 11 | 0.28 | 0.56 | 0.24 | 0.59 | 1.91 | — | 0.30 | 0.04 | 0.500 | 510 | 352 | 87 |
| | 12 | 0.29 | 0.59 | 0.21 | 0.53 | 1.88 | 0.05 | 0.30 | 0.04 | 0.492 | 510 | 361 | 86 |
| Comparative Example | 1 | 0.05 | 0.62 | 0.30 | 0.72 | 2.18 | — | — | — | 0.081 | 510 | 342 | 87 |
| | 2 | 0.45 | 0.61 | 0.19 | 0.61 | 1.75 | — | — | — | 0.738 | 510 | 340 | 87 |
| | 3 | 0.23 | 0.32 | 0.21 | 0.71 | 1.78 | — | — | — | 0.719 | 510 | 349 | 87 |
| | 4 | 0.26 | 0.95 | 0.21 | 0.57 | 1.99 | — | — | — | 0.274 | 510 | 351 | 87 |
| | 5 | 0.23 | 0.59 | 0.07 | 0.66 | 1.91 | — | — | — | 0.390 | 510 | 332 | 87 |
| | 6 | 0.31 | 0.57 | 0.42 | 0.75 | 1.84 | — | — | — | 0.544 | 510 | 340 | 87 |
| | 7 | 0.27 | 0.61 | 0.21 | 0.12 | 1.98 | — | — | — | 0.443 | 510 | 344 | 87 |
| | 8 | 0.27 | 0.55 | 0.22 | 0.89 | 2.00 | — | — | — | 0.491 | 510 | 363 | 87 |
| | 9 | 0.24 | 0.58 | 0.21 | 0.58 | 1.20 | — | — | — | 0.414 | 510 | 338 | 87 |
| | 10 | 0.26 | 0.60 | 0.21 | 0.55 | 2.83 | — | — | — | 0.433 | 510 | 339 | 87 |
| | 11 | 0.34 | 0.42 | 0.29 | 0.74 | 1.71 | — | — | — | 0.810 | 510 | 347 | 87 |

TABLE 1-continued

| | | | | | | | | | | | | | |
|---|---|---|---|---|---|---|---|---|---|---|---|---|---|
| | 12 | 0.25 | 0.53 | 0.18 | 0.51 | 2.00 | 0.15 | — | — | 0.472 | 510 | 345 | 87 |
| | 13 | 0.27 | 0.53 | 0.24 | 0.51 | 2.00 | — | — | 0.16 | 0.509 | — | — | — |
| | 14 | 0.27 | 0.61 | 0.22 | 0.24 | 2.42 | — | — | — | 0.443 | 440 | — | — |
| | 15 | 0.24 | 0.54 | 0.28 | 0.73 | 2.27 | — | — | — | 0.444 | 540 | 348 | 84 |
| | 16 | 0.26 | 0.58 | 0.19 | 0.53 | 2.09 | — | — | — | 0.448 | 510 | 284 | — |
| | 17 | 0.29 | 0.58 | 0.19 | 0.53 | 2.09 | — | — | — | 0.500 | 510 | 393 | — |
| | 18 | 0.25 | 0.60 | 0.21 | 0.50 | 1.94 | — | — | — | 0.417 | 510 | 345 | 76 |
| | 19 | 0.25 | 0.60 | 0.23 | 0.66 | 2.21 | — | — | — | 0.417 | 510 | 345 | 92 |
| | 20 | 0.28 | 0.44 | 0.24 | 1.06 | 1.05 | — | — | — | 0.636 | 510 | 346 | — |

| Specimen Category | No. | Production results | Area fraction of $Mg_2Si$ intermetallic compound grains [%] | Proof stress after baking at 270° C. for 20 s [N/mm$^2$] | Evaluations of DI-can forming: Ironing workability | Flange formability | Pressure strength [kPa] | Flow marks |
|---|---|---|---|---|---|---|---|---|
| Example | 1 | | 0.10 | 234 | Good | Good | 665 | Good |
| | 2 | | 0.12 | 246 | Good | Good | 697 | Good |
| | 3 | | 0.13 | 238 | Good | Good | 676 | Good |
| | 4 | | 0.17 | 244 | Good | Good | 692 | Good |
| | 5 | | 0.15 | 243 | Good | Good | 690 | Good |
| | 6 | | 0.13 | 242 | Good | Good | 687 | Good |
| | 7 | | 0.12 | 241 | Good | Good | 683 | Good |
| | 8 | | 0.13 | 226 | Good | Good | 649 | Good |
| | 9 | | 0.13 | 240 | Good | Good | 682 | Good |
| | 10 | | 0.13 | 242 | Good | Good | 687 | Good |
| | 11 | | 0.13 | 239 | Good | Good | 679 | Good |
| | 12 | | 0.14 | 230 | Good | Good | 653 | Good |
| Comparative Example | 1 | | 0.03 | 273 | Poor | Poor | 769 | Good |
| | 2 | | 0.21 | 255 | Poor | Good | 668 | Good |
| | 3 | | 0.12 | 253 | Poor | Good | 665 | Good |
| | 4 | | 0.13 | 238 | Good | Poor | 675 | Good |
| | 5 | | 0.12 | 217 | Good | Good | 626 | Good |
| | 6 | | 0.15 | 271 | Poor | Poor | 768 | Good |
| | 7 | | 0.13 | 215 | Good | Good | 619 | Good |
| | 8 | | 0.13 | 266 | Poor | Good | 726 | Good |
| | 9 | | 0.12 | 199 | Good | Good | 574 | Good |
| | 10 | | 0.13 | 279 | Poor | Poor | 778 | Poor |
| | 11 | | 0.16 | 244 | Poor | Good | 693 | Good |
| | 12 | | 0.13 | 231 | Poor | Good | 655 | Good |
| | 13 | Filter clogged and hence casting was terminated. | — | — | — | — | — | — |
| | 14 | Soaking temperature was low and hence it was impossible to perform hot rolling. | — | — | — | — | — | — |
| | 15 | | 0.09 | 272 | Poor | Poor | 767 | Good |
| | 16 | Recrystallization did not occur in the hot coil and hence the subsequent steps including cold rolling were not performed. | — | — | — | — | — | — |
| | 17 | Seizing seriously occurred in the surfaces of the hot coil and hence the subsequent steps including cold rolling were not performed. | — | — | — | — | — | — |
| | 18 | | 0.12 | 222 | Good | Good | 639 | Good |
| | 19 | | 0.13 | 272 | Poor | Poor | 766 | Good |
| | 20 | Recrystallization did not occur in the hot coil and hence the subsequent steps including cold rolling were not performed. | — | — | — | — | — | — |

In Table 1, Examples 1 to 12 satisfied the requirements of the present invention and hence were good in terms of ironing workability, evaluation of flange formability, evaluation of pressure strength, and evaluation of flow marks.

In contrast, Comparative examples 1 to 20 did not satisfy at least one of the requirements of the present invention and hence provided poor results described below.

Hereinafter, the test results of Comparative examples will be described.

For Comparative example 1, since the Si content was less than the lower limit, the 0°-180° ear height became large. In addition, since the area fraction of $Mg_2Si$ intermetallic compound grains was less than the lower limit, the ironing workability and the flange formability were poor. For Comparative example 2, since the Si content was more than the upper limit, recrystallization did not occur in the hot coil. Thus, the worked structure remained and the ironing workability was poor.

For Comparative example 3, since the Fe content was less than the lower limit, recrystallization did not occur in the hot coil. Thus, the worked structure remained and the ironing workability was poor.

For Comparative example 4, since the Fe content was more than the upper limit, the size and amount of Al—Fe—Mn intermetallic compound grains excessively increased. As a result, the flange formability was poor.

For Comparative example 5, since the Cu content was less than the lower limit, the can strength became poor and the pressure strength was poor. For Comparative example 6, since the Cu content was more than the upper limit, recrystallization did not occur in the hot coil. Thus, the worked structure remained and hence the ironing workability was poor. The strength became excessively high and the flange formability was poor.

For Comparative example 7, since the Mn content was less than the lower limit, the can strength became poor and the pressure strength was poor. For Comparative example 8, since the Mn content was more than the upper limit, recrystallization did not occur in the hot coil and the worked structure remained. Thus, the ironing workability was poor.

For Comparative example 9, since the Mg content was less than the lower limit, the can strength became poor and the pressure strength was poor. For Comparative example 10, since the Mg content was more than the upper limit, seizing of the surfaces of the sheet occurred during the hot rolling and the flow-mark evaluation was poor. In addition, the strength became excessively high and the ironing workability and the flange formability were poor.

For Comparative example 11, since the Si/Fe was more than the specified value, recrystallization did not occur in the hot coil. Thus, the worked structure remained and hence the ironing workability was poor.

For Comparative example 12, since the Cr content was more than the upper limit, recrystallization did not occur in the hot coil. Thus, an unrecrystallized region remained and hence the ironing workability was poor. For Comparative example 13, since the Ti content was more than the upper limit, the filter was clogged during casting and the molten metal did not pass through the filter. Thus, the casting was terminated.

For Comparative example 14, since the temperature of the soaking was less than the lower limit, it was impossible to perform the hot rolling. For Comparative example 15, since the temperature of the soaking was more than the upper limit and the area fraction of $Mg_2Si$ intermetallic compound grains was less than the lower limit, the strength became excessively high. As a result, the ironing workability and the flange formability were poor.

For Comparative example 16, since the finish rolling temperature of the hot rolling was less than the lower limit, the worked structure (unrecrystallized region) remained in the hot coil. Thus, it was clear that the can formability would be poor and hence the subsequent steps including the cold rolling were not performed. For Comparative example 17, since the finish rolling temperature of the hot rolling was more than the upper limit, seizing of the surfaces of the hot coil seriously occurred. Thus, it was clear that the cans would have poor surface quality and hence have no commercial value. Accordingly, the subsequent steps including the cold rolling were not performed.

For Comparative example 18, since the rolling reduction of the cold rolling was less than the lower limit, the strength became poor and the pressure strength was poor. For Comparative example 19, since the rolling reduction of the cold rolling was more than the upper limit, the 45° ear height became large and the strength became excessively high. As a result, the ironing workability and the flange formability were poor.

For Comparative example 20, the Mn content was more than the specified value and the Mg content was less than the specified value. Thus, recrystallization did not occur in the hot coil and hence the subsequent steps including the cold rolling were not performed.

The aluminum-alloy sheet of Comparative example 20 was produced so as to match the existing aluminum-alloy sheet (Alloy A) described in Patent Literature 1. As has been demonstrated, when such an existing aluminum-alloy sheet is produced by soaking performed by a single heat treatment at a temperature lower than the typical heat-treatment temperatures, the desired material texture is not provided even at the stage of a hot coil. Accordingly, it was clear that, without actual evaluations, the resultant can bodies would have poor properties. Thus, it has been demonstrated that aluminum-alloy sheets according to the present invention are superior to existing aluminum-alloy sheets.

Although the present invention has been described so far in detail with reference to embodiments and Examples, the scope of the present invention is not limited to the foregoing description and is broadly understood on the basis of the description of Claims. In addition, it is apparent that various changes, modifications, and alterations can be made within the spirit and scope of the present invention on the basis of the foregoing description.

What is claimed is:

1. An aluminum-alloy sheet, comprising
0.10 to 0.40 mass % of Si,
0.35 to 0.80 mass % of Fe,
0.10 to 0.35 mass % of Cu,
0.20 to 0.80 mass % of Mn,
1.77 to 2.5 mass % of Mg, and
the balance being Al and unavoidable impurities,
wherein
a content ratio (Si/Fe) of Si to Fe is 0.75 or less,
an area fraction of $Mg_2Si$ intermetallic compound grains having a length of at least 1 μm is 0.10% or more in a central region in a thickness direction of a section of the aluminum-alloy sheet, and
the aluminum-alloy sheet has a proof stress of 225 to 270 $N/mm^2$ after baking at 270° C. for 20 seconds.

2. The aluminum-alloy sheet according to claim 1, further comprising at least one of 0.10 mass % or less of Cr, 0.40 mass % or less of Zn, and 0.10 mass % or less of Ti.

3. A method for producing the aluminum-alloy sheet according to claim 1 or 2 for a resin-coated can body, the method comprising:
melting an aluminum alloy having the composition of the aluminum-alloy sheet to obtain a molten alloy and casting the alloy into a slab;
homogenizing the slab by a single heat treatment at a maximum temperature of 450° C. to 530° C. to obtain a homogenized slab;
hot rolling the homogenized slab without being cooled, at a finish rolling temperature of 300° C. to 380° C. to form a hot-rolled sheet; and
cold rolling the hot-rolled sheet without being annealed, with a total rolling reduction of 80% to 90%.

4. The method according to claim 3, wherein the cold rolling is performed with a tandem mill.

5. The aluminum-alloy sheet according to claim 1, comprising 0.2 to 0.69 mass % of Mn.

6. The aluminum-alloy sheet according to claim 1, comprising 0.2 to 0.67 mass % of Mn.

7. The aluminum-alloy sheet according to claim 1, comprising 1.88 to 2.5 mass % of Mg.

* * * * *